US010290312B2

(12) United States Patent
Suzuki et al.

(10) Patent No.: US 10,290,312 B2
(45) Date of Patent: May 14, 2019

(54) SOUND SOURCE SEPARATION DEVICE AND SOUND SOURCE SEPARATION METHOD

(71) Applicant: Panasonic Intellectual Property Management Co., Ltd., Osaka (JP)

(72) Inventors: Ryoji Suzuki, Nara (JP); Hiromasa Ohashi, Osaka (JP); Naoya Tanaka, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/889,279

(22) Filed: Feb. 6, 2018

(65) Prior Publication Data

US 2018/0158467 A1 Jun. 7, 2018

Related U.S. Application Data

(63) Continuation of application No. PCT/JP2016/004391, filed on Sep. 29, 2016.

(30) Foreign Application Priority Data

Oct. 16, 2015 (JP) ..... 2015-205023

(51) Int. Cl.

| | |
|---|---|
| ***H04R 3/00*** | (2006.01) |
| ***H04R 3/14*** | (2006.01) |
| ***G10L 21/028*** | (2013.01) |
| ***G10L 21/0272*** | (2013.01) |
| ***H04R 3/02*** | (2006.01) |

(52) U.S. Cl.

CPC ..... *G10L 21/028* (2013.01); *G10L 21/0272* (2013.01); *H04R 3/02* (2013.01);

(Continued)

(58) Field of Classification Search

CPC ..... G10L 21/0272; G10L 21/028; H04R 2499/13; H04R 3/00; H04R 3/02; H04R 3/14

(Continued)

(56) References Cited

U.S. PATENT DOCUMENTS 5,694,474 A 12/1997 Ngo et al.
6,496,581 B1 * 12/2002 Finn ..... H04M 9/082 379/406.01

(Continued)

FOREIGN PATENT DOCUMENTS

EP 903726 A2 3/1999
EP 3312839 A1 4/2018

(Continued)

OTHER PUBLICATIONS

International Search Report of PCT application No. PCT/JP2016/004391 dated Dec. 6, 2016.

(Continued)

*Primary Examiner* — Vivian C Chin
*Assistant Examiner* — Friedrich Fahnert
(74) *Attorney, Agent, or Firm* — Greenblum & Bernstein, P.L.C.

(57) ABSTRACT

A sound source separation device includes a first microphone that picks up a first voice, a second microphone that picks up a second voice, a first crosstalk canceller that removes, from a voice signal of the first microphone, first crosstalk caused when the second voice is picked up by the first microphone, and a second crosstalk canceller that removes, from a voice signal of the second microphone, second crosstalk caused when the first voice is picked up by the second microphone. The first crosstalk canceller uses a voice signal in which the second crosstalk is removed from the voice signal of the second microphone to estimate and (Continued)

calculate a first interference signal indicative of a degree of the first crosstalk, and to remove the calculated first interference signal from the voice signal of the first microphone. The second crosstalk canceller uses a voice signal in which the first crosstalk is removed from the voice signal of the first microphone to estimate and calculate a second interference signal indicative of a degree of the second crosstalk, and to remove the calculated second interference signal from the voice signal of the second microphone.

6 Claims, 4 Drawing Sheets

(52) U.S. Cl.
CPC ..... *H04R 3/14* (2013.01); *H04R 3/00* (2013.01); *H04R 2499/13* (2013.01)

(58) Field of Classification Search
USPC ..... 381/58, 71.11, 77, 86, 92, 302, 310; 704/233, 226, 251; 379/406.01; 455/569.2
See application file for complete search history.

(56) References Cited

U.S. PATENT DOCUMENTS 6,505,057 B1* 1/2003 Finn ..... G10L 21/0208 455/557
2002/0141601 A1* 10/2002 Finn ..... H04R 3/005 381/92
2006/0023892 A1* 2/2006 Schultz ..... H04M 9/08 381/58
2009/0055180 A1* 2/2009 Coon ..... B60R 16/0373 704/251
2012/0099733 A1 4/2012 Wang et al.
2012/0189138 A1 7/2012 Sugiyama
2012/0294446 A1 11/2012 Visser et al.
2013/0179163 A1* 7/2013 Herbig ..... H04R 27/00 704/233
2016/0039356 A1* 2/2016 Talwar ..... H04R 3/00 381/86
2016/0171964 A1* 6/2016 Kim ..... H04M 9/082 381/71.11
2016/0171989 A1* 6/2016 Gupta ..... G10K 11/175 381/302

FOREIGN PATENT DOCUMENTS

JP 11-508105 7/1999
JP 2004-145172 5/2004
WO 1997/011538 3/1997
WO 2011/040549 4/2011
WO 2012/054750 4/2012
WO 2012/158340 11/2012

OTHER PUBLICATIONS

The Extended European Search Report dated May 30, 2018 for the related European Patent Application No. 16855097.8.

* cited by examiner

SOUND SOURCE SEPARATION DEVICE AND SOUND SOURCE SEPARATION METHOD

TECHNICAL FIELD

The present disclosure relates to a sound source separation device that performs signal processing for reducing crosstalk on a plurality of voice signals collected from a plurality of microphones.

BACKGROUND ART

PTL 1 discloses a sound source separation device that recovers source signals from a plurality of signals mixed in a space. The sound source separation device includes means for performing short-time Fourier transform on an observed signal, means for obtaining, through an independent component analysis, a separation matrix at each frequency at which short-time Fourier transform is performed, means for estimating an arrival direction of a signal taken from each row of the separation matrix at each frequency, means for determining whether its estimated value is fully reliable, and means for calculating a degree of similarity with respect to separation signals among the frequencies at which short-time Fourier transform is performed. Further included is means for, when resolving a permutation after a separation matrix is obtained at each frequency (replacement of a sound source at each frequency), determining the permutation by, at frequencies for which estimations of directions from which signals arrive are determined to be fully reliable, aligning the directions, and by, at other frequencies, increasing a degree of similarity with respect to separation signals at frequencies around the other frequencies. Therefore, while permutations are being resolved, source signals can be recovered.

CITATION LIST

Patent Literature

PTL 1: Unexamined Japanese Patent Publication No. 2004-145172

SUMMARY OF THE INVENTION

The present disclosure provides a sound source separation device capable of separating individual voice signals by reducing crosstalk from a plurality of voice signals collected from a plurality of microphones, using smaller hardware, without calculating separation matrices requiring a greater amount of computation.

The sound source separation device of the present disclosure includes a first microphone, a second microphone, a first crosstalk canceller that removes first crosstalk, and a second crosstalk canceller that removes second crosstalk. The first microphone picks up a first voice. The second microphone picks up a second voice. The first crosstalk canceller removes, from a voice signal of the first microphone, first crosstalk caused when the second voice is picked up by the first microphone. The second crosstalk canceller removes, from a voice signal of the second microphone, second crosstalk caused when the first voice is picked up by the second microphone. The first crosstalk canceller uses a voice signal in which the second crosstalk is removed from the voice signal of the second microphone to estimate and calculate a first interference signal indicative of a degree of the first crosstalk, and to remove the calculated first interference signal from the voice signal of the first microphone. The second crosstalk canceller uses a voice signal in which the first crosstalk is removed from the voice signal of the first microphone to estimate and calculate a second interference signal indicative of a degree of the second crosstalk, and to remove the calculated second interference signal from the voice signal of the second microphone.

A sound source separation method of the present disclosure is a sound source separation method performed in a sound source separation device that separates a first voice and a second voice from a voice signal including the first voice and the second voice. The sound source separation device includes a first microphone that picks up a first voice, and a second microphone that picks up a second voice. The sound source separation method includes a first crosstalk cancellation step of removing, from a voice signal of the first microphone, first crosstalk caused when the second voice is picked up by the first microphone, and a second crosstalk cancellation step of removing, from a voice signal of the second microphone, second crosstalk caused when the first voice is picked up by the second microphone. In the first crosstalk cancellation step, a voice signal in which the second crosstalk is removed from the voice signal of the second microphone in the second crosstalk cancellation step is used to estimate and calculate a first interference signal indicative of a degree of the first crosstalk, and to remove the calculated first interference signal from the voice signal of the first microphone. In the second crosstalk cancellation step, a voice signal in which the first crosstalk is removed from the voice signal of the first microphone in the first crosstalk cancellation step is used to estimate and calculate a second interference signal indicative of a degree of the second crosstalk, and to remove the calculated second interference signal from the voice signal of the second microphone.

The sound source separation device according to the present disclosure separates individual voice signals from voice signals collected from a plurality of microphones without calculating separation matrices requiring a greater amount of computation, and thus can reduce crosstalk using smaller hardware.

DESCRIPTION OF EMBODIMENTS

Exemplary embodiments will now be described herein in detail with reference to the drawings appropriately. However, a detailed description more than necessary may be omitted. For example, a detailed description of an already known item and a duplicated description of a substantially identical configuration may be omitted. Such omissions are aimed to prevent the following description from being redundant more than necessary, and to help those skilled in the art easily understand the following description.

Note that the attached drawings and the following description are provided, by the inventors, for those skilled in the art to fully understand the present disclosure, and are not intended to limit the subject matter described in the appended claims.

First Exemplary Embodiment

A first exemplary embodiment will now be described herein with reference to FIGS. 1 and 2.

[1-1. Exemplary Application]

Figure 1:
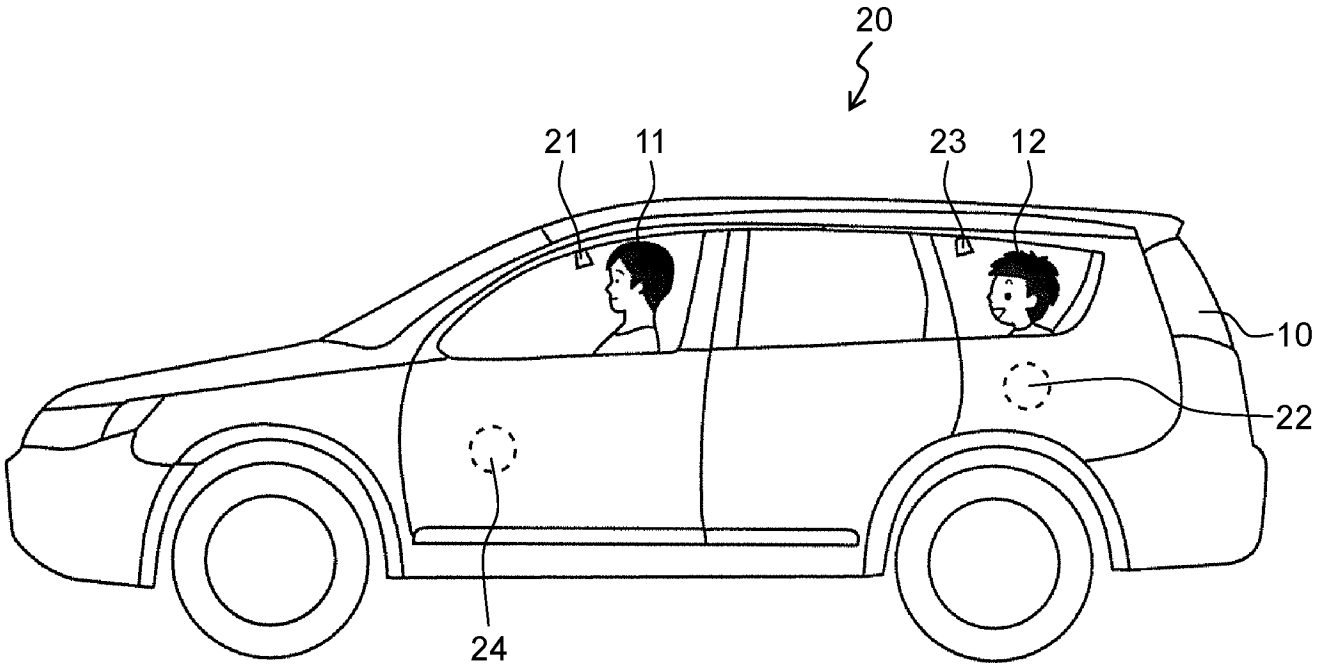
FIG. 1 is a view illustrating an exemplary application of a sound source separation device according to a first exemplary embodiment.

FIG. 1 is a view illustrating an exemplary application of sound source separation device 20 according to the first exemplary embodiment. Shown in here is an example where sound source separation device 20 is applied as a device for amplifying and assisting a two-way conversation in vehicle 10 (as a device for assisting in-cabin conversation).

Sound source separation device 20 is a device for amplifying and assisting a two-way conversation between first conversation participant 11 (in here, a driver) and second conversation participant 12 (in here, a rear passenger). At a ceiling above a driver's seat, first microphone 21 that picks up a voice (a first voice) of first conversation participant 11 is provided, and, at each of inside faces on sides of a rear seat, first loud speaker 22 for outputting the first voice is provided. In addition, at the ceiling above the rear seat, second microphone 23 that picks up a voice (a second voice) of second conversation participant 12 is provided, and, at each of inside faces of two front doors, second loud speaker 24 for outputting the second voice is provided.

With sound source separation device 20, first conversation participant 11 and second conversation participant 12 are able to enjoy two-way conversations, in which acoustic noises including crosstalk are removed, even in one narrower space in this vehicle. Crosstalk refers to a phenomenon where a voice of a conversation participant is picked up by a microphone that picks up a voice of another conversation participant, and in here refers to a phenomenon where a voice of second conversation participant 12 is picked up by first microphone 21, and a phenomenon where a voice of first conversation participant 11 is picked up by second microphone 23.

[1-2. Configuration]

Figure 2:
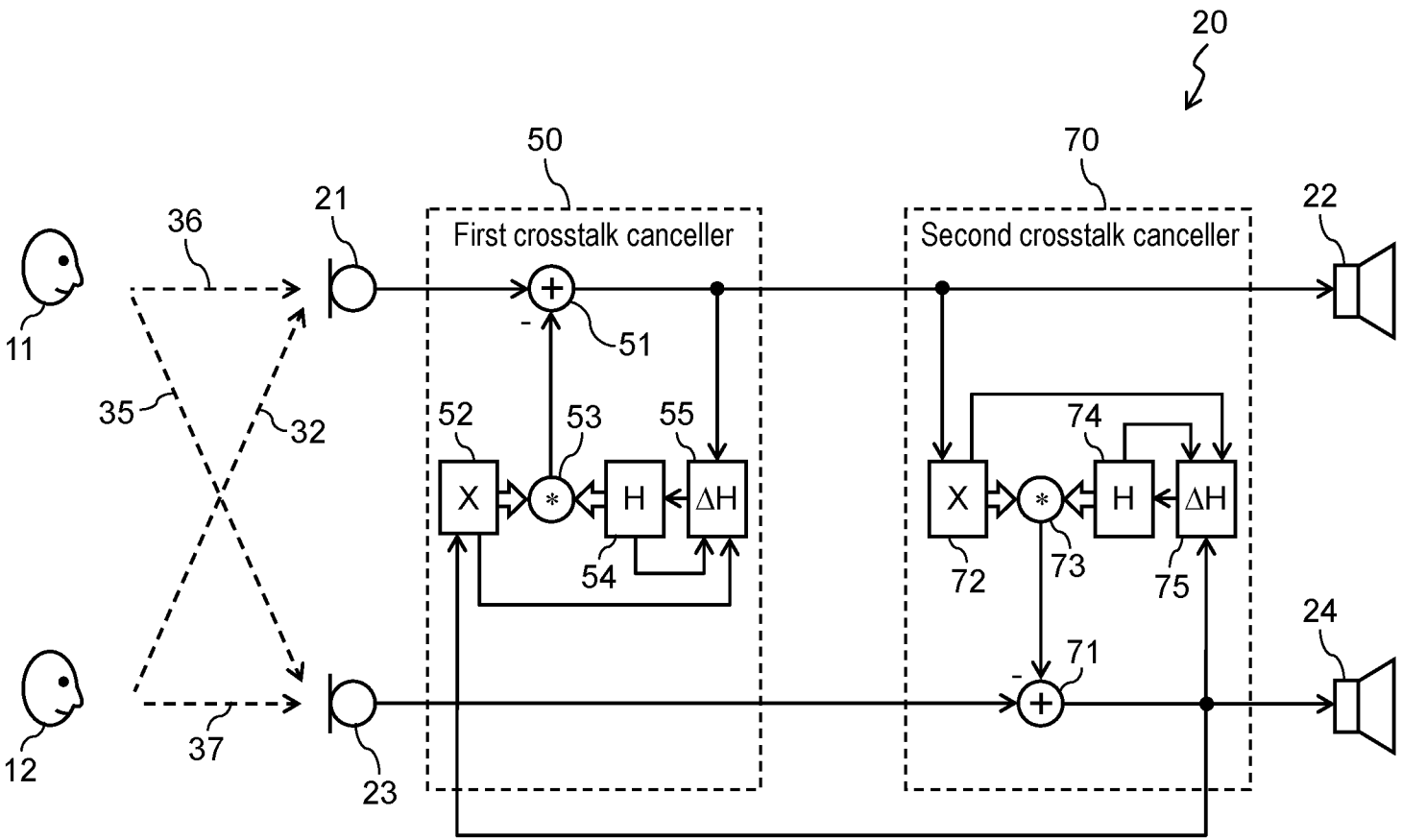
FIG. 2 is a block diagram illustrating a configuration of the sound source separation device illustrated in FIG. 1.

FIG. 2 is a block diagram illustrating a configuration of sound source separation device 20 illustrated in FIG. 1. Sound source separation device 20 includes first microphone 21, first loud speaker 22, second microphone 23, second loud speaker 24, first crosstalk canceller 50, and second crosstalk canceller 70. Components of sound source separation device 20 are connected to each other in a wired or wireless manner. In addition, first crosstalk canceller 50 and second crosstalk canceller 70 are mounted, for example, as parts of a head unit for vehicle 10.

First microphone 21 is a microphone that picks up voice 36 of a first conversation participant 11, and is provided, for example, at the ceiling above the driver's seat in vehicle 10, as illustrated in FIG. 1. A voice signal output from first microphone 21 is, for example, digital voice data generated by a built-in analog/digital (A/D) converter.

First loud speaker 22 is a loud speaker for outputting voice 36 of the first conversation participant 11, and is provided, for example, at each of the inside faces on both the sides of the rear seat of vehicle 10, as illustrated in FIG. 1. For example, after digital voice data that is a voice signal from first microphone 21 is input and converted into an analog signal by a built-in digital/analog (D/A) converter, first loud speaker 22 outputs the analog signal as a voice.

Second microphone 23 is a microphone that picks up voice 37 of a second conversation participant 12, and is provided, for example, at the ceiling above the rear seat, as illustrated in FIG. 1. A voice signal output from second microphone 23 is, for example, digital voice data generated by the built-in A/D converter.

Second loud speaker 24 is a loud speaker for outputting voice 37 of the second conversation participant 12, and is provided, for example, at each of the inside faces of the two front doors of vehicle 10, as illustrated in FIG. 1. For example, after digital voice data that is a voice signal from second microphone 23 is input and converted into an analog signal by the built-in D/A converter, second loud speaker 24 outputs the analog signal as a voice.

[1-2-1. First Crosstalk Canceller 50]

First crosstalk canceller 50 uses an output signal of second crosstalk canceller 70 to estimate and calculate a first interference signal indicative of a degree of first crosstalk 32 caused when a voice of second conversation participant 12 is picked up by first microphone 21. First crosstalk canceller 50 removes the calculated first interference signal from an output signal of first microphone 21, and outputs a signal obtained after the removal to first loud speaker 22. In this exemplary embodiment, first crosstalk canceller 50 is a digital signal processing circuit for processing digital voice data in a time axis domain.

More specifically, first crosstalk canceller 50 includes first transfer function storage circuit 54, first storage circuit 52, first convolution operation unit 53, first subtractor 51, and first transfer function update circuit 55.

First transfer function storage circuit 54 stores a transfer function estimated as a transfer function with respect to first crosstalk 32.

First storage circuit 52 stores a signal output from second crosstalk canceller 70.

First convolution operation unit 53 performs a convolution on the signal stored in first storage circuit 52 and the transfer function stored in first transfer function storage circuit 54 to generate a first interference signal. For example, first convolution operation unit 53 is an N-tap Finite Impulse Response (FIR) filter for performing a convolution operation represented by equation 1 described below.

[Equation 1]

$$y1'_t = \sum_{i=0}^{N-1} \{H1(i)_t \times x1(t-i)\} \tag{1}$$

Where, $y1'_t$ represents a first interference signal at time t. N represents a number of taps in the FIR filter. $H1(i)_t$ represents an i-th transfer function at time t among a number of N of transfer functions stored in first transfer function storage circuit 54. x1(t−i) represents a (t−i)th signal among signals stored in first storage circuit 52.

First subtractor 51 removes, from an output signal of first microphone 21, a first interference signal output from first convolution operation unit 53, and outputs an obtained signal as an output signal of first crosstalk canceller 50. For example, first subtractor 51 performs a subtraction represented by equation 2 illustrated below.

[Equation 2]

$$e1_t = y1_t - y1'_t \tag{2}$$

Where, $e1_t$ represents an output signal of first subtractor 51 at time t. $y1_t$ represents an output signal of first microphone 21 at time t.

First transfer function update circuit 55 updates the transfer function stored in first transfer function storage circuit 54 based on the output signal of first subtractor 51 and the signal stored in first storage circuit 52. For example, first transfer function update circuit 55 uses an independent component analysis, as represented by equation 3 illustrated below, to update the transfer function stored in first transfer function storage circuit 54 based on the output signal of first subtractor 51 and the signal stored in first storage circuit 52 so that the output signal of first subtractor 51 and the signal stored in first storage circuit 52 are independent from each other.

[Equation 3]

$$H1(j)_{t+1}=H1(j)_t+\alpha 1\times \varnothing 1(e1_t)\times x1(t-j) \tag{3}$$

Where, $H1(j)_{t+1}$ represents a j-th transfer function at time t+1 (i.e., after updated) among the number of N of transfer functions stored in first transfer function storage circuit 54. $H1(j)_t$ represents the j-th transfer function at time t (i.e., before updating) among the number of N of transfer functions stored in first transfer function storage circuit 54. $\alpha 1$ represents a step size parameter for controlling a learning speed in estimating a transfer function with respect to first crosstalk 32. $\phi 1$ represents a nonlinear function (e.g., a sigmoid function, a hyperbolic tangent function (a tan h function), a normalized linear function, or a sign function.

As described above, first transfer function update circuit 55 performs nonlinear processing using a nonlinear function on the output signal of first subtractor 51. Further, first transfer function update circuit 55 multiplies an obtained result by the signal stored in first storage circuit 52 and a first step size parameter for controlling a learning speed in estimating a transfer function with respect to first crosstalk 32 to calculate a first update coefficient. Then, first transfer function update circuit 55 adds the calculated first update coefficient to the transfer function stored in first transfer function storage circuit 54 for updating.

[1-2-2. Second Crosstalk Canceller 70]

Second crosstalk canceller 70 uses an output signal of first crosstalk canceller 50 to estimate and calculate a second interference signal indicative of a degree of second crosstalk 35 caused when a voice of first conversation participant 11 is picked up by second microphone 23. In addition, the calculated second interference signal is removed from an output signal of second microphone 23, and a signal obtained after the removal is output to second loud speaker 24. In this exemplary embodiment, second crosstalk canceller 70 is a digital signal processing circuit for processing digital voice data in a time axis domain.

More specifically, second crosstalk canceller 70 includes second transfer function storage circuit 74, second storage circuit 72, second convolution operation unit 73, second subtractor 71, and second transfer function update circuit 75.

Second transfer function storage circuit 74 stores a transfer function estimated as a transfer function with respect to second crosstalk 35.

Second storage circuit 72 stores a signal output from first crosstalk canceller 50.

Second convolution operation unit 73 performs a convolution on the signal stored in second storage circuit 72 and the transfer function stored in second transfer function storage circuit 74 to generate a second interference signal. For example, second convolution operation unit 73 is an N-tap FIR filter for performing a convolution operation represented by equation 4 illustrated below.

[Equation 4]

$$y2'_t=\sum_{i=0}^{N-1}\{H2(i)_t\times x2(t-i)\} \tag{4}$$

Where, $y2'_t$ represents a second interference signal at time t. N represents a number of taps in the FIR filter. $H2(i)_t$ represents an i-th transfer function at time t among N number of transfer functions stored in second transfer function storage circuit 74. x2(t−i) represents a (t−i)th signal among signals stored in second storage circuit 72.

Second subtractor 71 removes, from an output signal of second microphone 23, a second interference signal output from second convolution operation unit 73, and outputs an obtained signal as an output signal of second crosstalk canceller 70. For example, second subtractor 71 performs a subtraction represented by equation 5 illustrated below.

[Equation 5]

$$e2_t=y2_t-y2'_t \tag{5}$$

Where, $e2_t$ represents an output signal of second subtractor 71 at time t. $y2_t$ represents an output signal of second microphone 23 at time t.

Second transfer function update circuit 75 updates the transfer function stored in second transfer function storage circuit 74 based on the output signal of second subtractor 71 and the signal stored in second storage circuit 72. For example, second transfer function update circuit 75 uses an independent component analysis, as represented by equation 6 illustrated below, to update the transfer function stored in second transfer function storage circuit 74 based on the output signal of second subtractor 71 and the signal stored in second storage circuit 72 so that the output signal of second subtractor 71 and the signal stored in second storage circuit 72 are independent from each other.

[Equation 6]

$$H2(j)_{t+1}=H2(j)_t+\alpha 2\times \varnothing 2(e2_t)\times x2(t-j) \tag{6}$$

Where, $H2(j)_{t+1}$ represents a j-th transfer function at time t+1 (i.e., after updating) among N number of transfer functions stored in second transfer function storage circuit 74. H2(j)t represents the j-th transfer function at time t (i.e., before updating) among the N number of transfer functions stored in second transfer function storage circuit 74. $\alpha 2$ represents a step size parameter for controlling a learning speed in estimating a transfer function with respect to second crosstalk 35. $\phi 2$ represents a nonlinear function (e.g., a sigmoid function, a hyperbolic tangent function (a tan h function), a normalized linear function, or a sign function.

As described above, second transfer function update circuit 75 performs nonlinear processing using a nonlinear function on the output signal of second subtractor 71. Further, second transfer function update circuit 75 multiplies an obtained result by the signal stored in second storage circuit 72 and a second step size parameter for controlling a learning speed in estimating a transfer function with respect to second crosstalk 35 to calculate a second update coefficient. Then, second transfer function update circuit 75 adds the calculated second update coefficient to the transfer function stored in second transfer function storage circuit 74 for updating.

Sound source separation device 20 according to this exemplary embodiment is designed so that, for a voice of second conversation participant 12 uttered at a certain time, a time when an output signal of second crosstalk canceller 70 is input into first crosstalk canceller 50 is identical to or earlier than a time when a voice of second conversation participant 12 is picked up by first microphone 21. In other words, a law of cause and effect is maintained so that first crosstalk canceller 50 can cancel first crosstalk 32. This can appropriately be achieved by taking into account factors for determining a time when an output signal of second crosstalk canceller 70 is input into first crosstalk canceller 50 (a speed of an A/D conversion, a processing speed in first crosstalk canceller 50, a processing speed in second crosstalk canceller 70, and other speeds) and factors for determining a time when a voice of second conversation participant 12 is picked up by first microphone 21 (a positional relationship between second conversation participant 12 and first microphone 21, and other relationships).

Similarly, sound source separation device 20 according to this exemplary embodiment is designed so that, for a voice of first conversation participant 11 uttered at a certain time, a time when an output signal of first crosstalk canceller 50 is input into second crosstalk canceller 70 is identical to or earlier than a time when a voice of first conversation participant 11 is picked up by second microphone 23. In other words, a law of cause and effect is maintained so that second crosstalk canceller 70 can cancel second crosstalk 35. This can appropriately be achieved by taking into account factors for determining a time when an output signal of first crosstalk canceller 50 is input into second crosstalk canceller 70 (a speed of an A/D conversion, a processing speed in first crosstalk canceller 50, a processing speed in second crosstalk canceller 70, and other speeds) and factors for determining a time when a voice of first conversation participant 11 is picked up by second microphone 23 (a positional relationship between first conversation participant 11 and second microphone 23, and other positional relationships).

[1-3. Operation]

In sound source separation device 20 according to this exemplary embodiment configured as described above, voice 36 of the first conversation participant 11 and voice 37 of the second conversation participant 12 are processed as described below.

Voice 36 of the first conversation participant 11 is picked up by first microphone 21. First crosstalk canceller 50 removes a first interference signal from an output signal of first microphone 21. A first interference signal is an (estimated) signal indicative of a degree of first crosstalk 32. Therefore, an output signal of first crosstalk canceller 50 is a signal representing a voice in which an effect of first crosstalk 32 is removed from the voice picked up by first microphone 21. This voice signal is output from first loud speaker 22 as a voice. That is, the output signal of first crosstalk canceller 50 is, as illustrated in FIG. 2, a voice signal of first microphone 21, in which first crosstalk 32 is removed, and is an input signal for first loud speaker 22.

Therefore, the voice output from first loud speaker 22 is the voice in which the effect of first crosstalk 32 is removed from the voice picked up by first microphone 21, in other words, is only separated voice 36 of the first conversation participant 11.

Similarly, voice 37 of the second conversation participant 12 is picked up by second microphone 23. Second crosstalk canceller 70 removes a second interference signal from an output signal of second microphone 23. A second interference signal is an (estimated) signal indicative of a degree of second crosstalk 35. Therefore, an output signal of second crosstalk canceller 70 is a signal representing a voice in which an effect of second crosstalk 35 is removed from the voice picked up by second microphone 23. This voice signal is output from second loud speaker 24 as a voice. That is, the output signal of second crosstalk canceller 70 is, as illustrated in FIG. 2, a voice signal of second microphone 23, in which second crosstalk 35 is removed, and is an input signal for second loud speaker 24.

Therefore, the voice output from second loud speaker 24 is the voice in which the effect of second crosstalk 35 is removed from the voice picked up by second microphone 23, in other words, is only separated voice 37 of the second conversation participant 12.

It is needless to say that degrees at which voice 36 of the first conversation participant 11 and voice 37 of the second conversation participant 12 are respectively separated depend on factors including accuracy of transfer functions retained in first crosstalk canceller 50 and second crosstalk canceller 70, and parameters used in the updating equations for transfer functions, which are represented by equations 3 and 6 described above.

[1-4. Effects and Other Benefits]

As described above, sound source separation device 20 according to this exemplary embodiment includes first microphone 21 and first crosstalk canceller 50. Sound source separation device 20 is also designed so that, for a voice of second conversation participant 12 uttered at a certain time, a time when a signal is input into first crosstalk canceller 50 is identical to or earlier than a time when a voice of second conversation participant 12 is picked up by first microphone 21. Therefore, first crosstalk canceller 50 estimates and removes, from an output signal of first microphone 21, first crosstalk 32 caused when a voice of second conversation participant 12 is picked up by first microphone 21.

Therefore, first crosstalk canceller 50 that is an adaptive filter is used to separate voice 36 of the first conversation participant 11, which is picked up by first microphone 21, and a voice of second conversation participant 12 (first crosstalk 32), and to extract only voice 36 of the first conversation participant 11. Therefore, relatively smaller hardware can be used to suppress amplifying of a voice from first loud speaker 22 due to first crosstalk 32.

Similarly, sound source separation device 20 according to this exemplary embodiment includes second microphone 23 and second crosstalk canceller 70. Sound source separation device 20 is also designed so that, for a voice of first conversation participant 11 uttered at a certain time, a time when a signal is input into second crosstalk canceller 70 is identical to or earlier than a time when a voice of first conversation participant 11 is picked up by second microphone 23. Therefore, second crosstalk canceller 70 estimates second crosstalk 35 caused when a voice of first conversation participant 11 is picked up by second microphone 23, and removes second crosstalk 35 from an output signal of second microphone 23.

Therefore, second crosstalk canceller 70 that is an adaptive filter is used to separate voice 37 of the second conversation participant 12, which is picked up by second microphone 23, and a voice of first conversation participant 11 (second crosstalk 35), and to extract only voice 37 of the second conversation participant 12. Amplifying a voice from second loud speaker 24 due to second crosstalk 35 is thus suppressed without increasing hardware.

[1-5. Modification]

In the above described exemplary embodiment, first transfer function update circuit 55 has updated a transfer function in accordance with equation 3 described above. However, a transfer function may be updated in accordance with a normalized equation, as represented by equation 7 or 8 illustrated below.

[Equation 7]

$$H1(j)_{t+1} = H1(j)_t + \alpha 1 \times N \times \phi 1(e1_t) \times x1(t-j) \Big/ \sum_{i=0}^{N-1} |x1(t-i)| \tag{7}$$

Where, N represents a number of transfer functions stored in first transfer function storage circuit 54. |x1(t−i)| represents an absolute value of x1(t−i).

[Equation 8]

$$H1(j)_{t+1} = H1(j)_t + \alpha 1 \times N \times \phi 1(e1_t) \times x1(t-i) \Big/ \sum_{i=0}^{N-1} x1(t-j)^2 \tag{8}$$

Therefore, first transfer function update circuit 55 can stably update an estimated transfer function without depending on amplitude of input signal x1(t−j).

Similarly, second transfer function update circuit 75 has updated a transfer function in accordance with equation 6 described above. However, a transfer function may be updated in accordance with a normalized equation, as represented by equation 9 or 10 illustrated below.

[Equation 9]

$$H2(j)_{t+1} = H2(j)_t + \alpha 2 \times N \times \phi 2(e2_t) \times x2(t-j) \Big/ \sum_{i=0}^{N-1} |x2(t-i)| \tag{9}$$

Where, N represents a number of transfer functions stored in second transfer function storage circuit 74. |x2(t−i)| represents an absolute value of x2(t−i).

[Equation 10]

$$H2(j)_{t+1} = H2(j)_t + \alpha 2 \times N \times \phi 2(e2_t) \times x2(t-j) \Big/ \sum_{i=0}^{N-1} x2(t-i)^2 \tag{10}$$

Therefore, second transfer function update circuit 75 can stably update an estimated transfer function without depending on amplitude of input signal x2(t−j).

In addition, the above described exemplary embodiment is an exemplary application of a sound source separation device to a device for assisting in-cabin conversation. However, the sound source separation device is not limited to the device for assisting in-cabin conversation, but may be applied to a voice recognizer. More specifically, a voice can highly precisely be recognized by allowing the sound source separation device described above to separate voice signals of individual conversation participants, and to process the separated voice signals of the individual conversation participants with the voice recognizer. When a sound source separation device is applied to a voice recognizer, a loud speaker is not essential, differently from a case when the sound source separation device is applied to a device for assisting in-cabin conversation.

In addition, the above described exemplary embodiment may be achieved as a sound source separation method as described below. In other words, with the sound source separation method, a sound source separation device separates voice 36 of the first conversation participant 11 and voice 37 of the second conversation participant 12. The sound source separation device includes first microphone 21 that picks up voice 36 of the first conversation participant 11, and second microphone 23 that picks up voice 37 of the second conversation participant 12. The sound source separation method includes a first crosstalk cancellation step and a second crosstalk cancellation step.

In the first crosstalk cancellation step, an output signal of the second crosstalk cancellation step is used to estimate and calculate a first interference signal indicative of a degree of first crosstalk 32 caused when a voice of second conversation participant 12 is picked up by first microphone 21. In addition, the calculated first interference signal is removed from an output signal of first microphone 21. An output signal of the first crosstalk cancellation step may be output from a loud speaker as a voice signal obtained by separating only voice 36 of the first conversation participant 11, as well as may be processed by the voice recognizer.

In the second crosstalk cancellation step, an output signal of the first crosstalk cancellation step is used to estimate and calculate a second interference signal indicative of a degree of second crosstalk 35 caused when a voice of first conversation participant 11 is picked up by second microphone 23. In addition, the calculated second interference signal is removed from an output signal of second microphone 23. An output signal of the second crosstalk cancellation step may be output from a loud speaker as a voice signal obtained by separating only voice 37 of the second conversation participant 12, as well as may be processed by the voice recognizer.

The sound source separation method as described above is performed by, for example, a processor for executing a program. In other words, first crosstalk canceller 50 and second crosstalk canceller 70 according to the above described exemplary embodiment may be achieved by a processor for executing a program.

In addition, the sound source separation method as described above may be achieved by a program recorded in a computer readable recording medium such as a CD-ROM.

Second Exemplary Embodiment

Next, a sound source separation device according to a second exemplary embodiment will now be described herein. Similarly to the sound source separation device according to the first exemplary embodiment, the sound source separation device according to this exemplary embodiment is applied to a device for amplifying and assisting a two-way conversation between a first conversation participant 11 and a second conversation participant 12. However, the device is advantageous when acoustic coupling is so greater to an extent that indirect first crosstalk 32*a* caused when a voice of second conversation participant 12, which is output from second loud speaker 24, is picked up by first microphone 21 and indirect second crosstalk 35*a* caused when a voice of first conversation participant 11, which is output from first loud speaker 22, is picked up by second microphone 23, in addition to first crosstalk 32 and second crosstalk 35 described in the first exemplary embodiment, cannot be neglected.

[2-1. Configuration]

Figure 3:
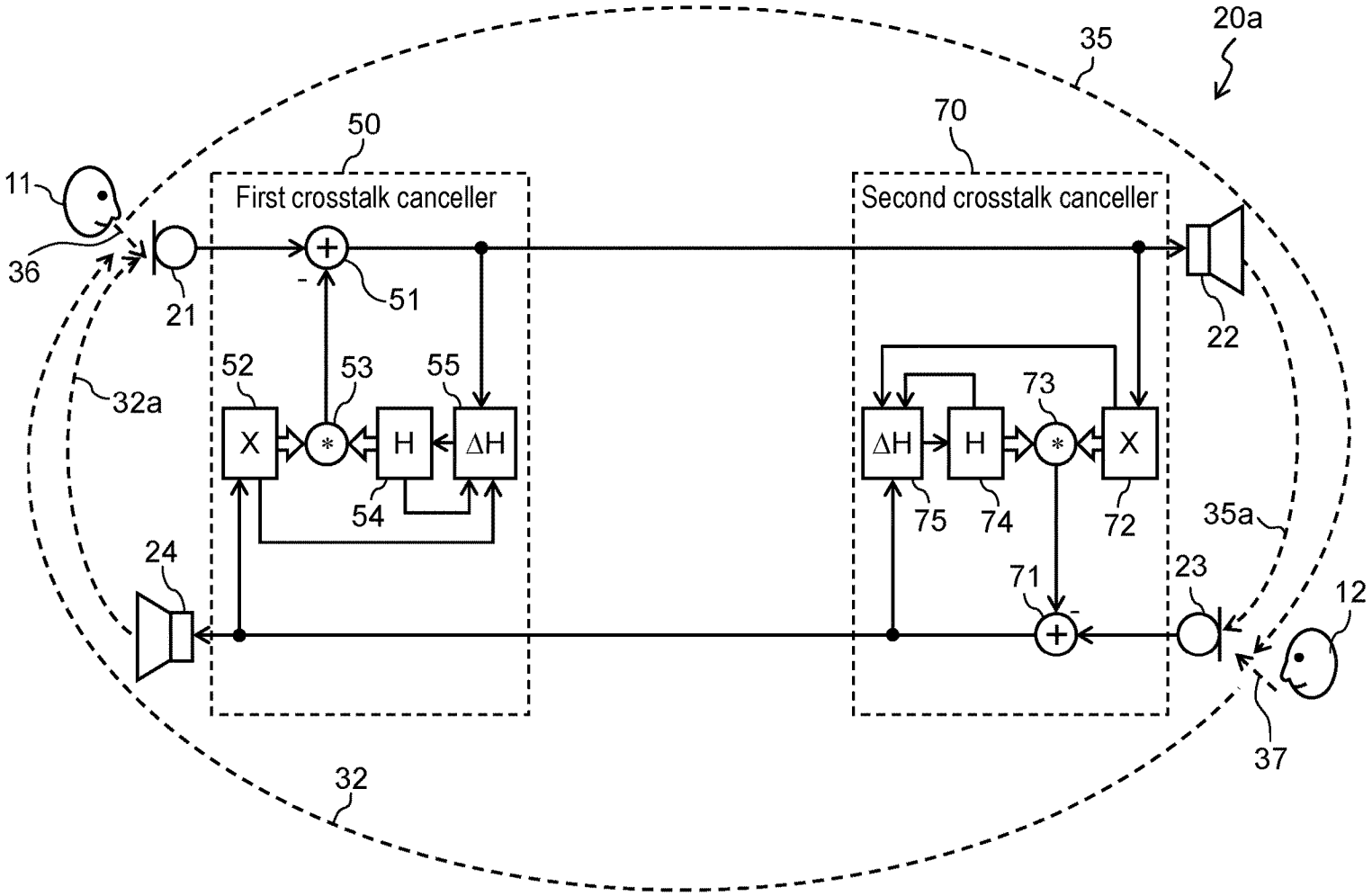
FIG. 3 is a block diagram illustrating a configuration of a sound source separation device according to a second exemplary embodiment.

FIG. 3 is a block diagram illustrating a configuration of sound source separation device 20*a* according to the second exemplary embodiment. The configuration of sound source separation device 20*a* is substantially identical to the configuration of sound source separation device 20 according to the first exemplary embodiment. Hereinafter, components identical to components of the first exemplary embodiment are denoted by numerals or symbols identical to numerals or symbols used in the first exemplary embodiment, and descriptions of the components are omitted.

Sound source separation device 20*a* includes first microphone 21, first loud speaker 22, second microphone 23, second loud speaker 24, first crosstalk canceller 50, and second crosstalk canceller 70. The components are substantially identical to corresponding components of sound source separation device 20 according to the first exemplary embodiment. However, in sound source separation device 20*a*, compared with sound source separation device 20, first transfer function storage circuit 54 and second transfer function storage circuit 74 store different transfer functions.

First transfer function storage circuit 54 stores a transfer function estimated as a transfer function with respect to first crosstalk 32 and indirect first crosstalk 32*a* combined to each other.

Therefore, first crosstalk canceller 50 uses an output signal of second crosstalk canceller 70 to estimate and calculate a first interference signal indicative of degrees of first crosstalk 32 and indirect first crosstalk 32*a* combined to each other. In addition, the calculated first interference signal is removed from an output signal of first microphone 21, and a signal obtained after the removal is output to first loud speaker 22.

Second transfer function storage circuit 74 stores a transfer function estimated as a transfer function with respect to second crosstalk 35 and indirect second crosstalk 35*a* combined to each other.

Therefore, second crosstalk canceller 70 uses an output signal of first crosstalk canceller 50 to estimate and calculate a second interference signal indicative of degrees of second crosstalk 35 and indirect second crosstalk 35*a* combined to each other. In addition, the calculated second interference signal is removed from an output signal of second microphone 23, and a signal obtained after the removal is output to second loud speaker 24.

In sound source separation device 20*a*, first microphone 21 and second loud speaker 24 are provided in an environment where acoustic coupling is so greater to an extent that indirect first crosstalk 32*a* caused when a voice of second conversation participant 12, which is output from second loud speaker 24, is picked up by first microphone 21 cannot be neglected. For example, second loud speaker 24 is provided at a position from which a voice is output toward first microphone 21 (or, has such a voice output directional characteristic).

Similarly, second microphone 23 and first loud speaker 22 are provided in an environment where acoustic coupling is so greater to an extent that indirect second crosstalk 35*a* caused when a voice of first conversation participant 11, which is output from first loud speaker 22, is picked up by second microphone 23 cannot be neglected. For example, first loud speaker 22 is provided at a position from which a voice is output toward second microphone 23 (or, has such a voice output directional characteristic).

[2-2. Operation]

In sound source separation device 20*a* according to this exemplary embodiment configured as described above, voice 36 of the first conversation participant 11 and voice 37 of the second conversation participant 12 are processed as described below.

Voice 36 of the first conversation participant 11 is picked up by first microphone 21. First crosstalk canceller 50 removes a first interference signal from an output signal of first microphone 21. A first interference signal is an (estimated) signal indicative of degrees of first crosstalk 32 and indirect first crosstalk 32*a* combined to each other. Therefore, an output signal of first crosstalk canceller 50 is a signal representing a voice in which effects of first crosstalk 32 and indirect first crosstalk 32*a* are removed from the voice picked up by first microphone 21. This voice signal is output from first loud speaker 22 as a voice. That is, the output signal of first crosstalk canceller 50 is, as illustrated in FIG. 3, a voice signal of first microphone 21, in which first crosstalk 32 and indirect first crosstalk 32*a* are removed, and is an input signal for first loud speaker 22.

Therefore, the voice output from first loud speaker 22 is the voice in which the effects of first crosstalk 32 and indirect first crosstalk 32*a* are removed from the voice picked up by first microphone 21, in other words, is only separated voice 36 of the first conversation participant 11.

Similarly, voice 37 of the second conversation participant 12 is picked up by second microphone 23. Second crosstalk canceller 70 removes a second interference signal from an output signal of second microphone 23. A second interference signal is an (estimated) signal indicative of degrees of second crosstalk 35 and indirect second crosstalk 35*a* combined to each other. Therefore, an output signal of second crosstalk canceller 70 is a signal representing a voice in which effects of second crosstalk 35 and indirect second crosstalk 35*a* are removed from the voice picked up by second microphone 23. This voice signal is output from second loud speaker 24 as a voice. That is, the output signal of second crosstalk canceller 70 is, as illustrated in FIG. 3, a voice signal of second microphone 23, in which second crosstalk 35 and indirect second crosstalk 35*a* are removed, and is an input signal for second loud speaker 24.

Therefore, the voice output from second loud speaker 24 is the voice in which the effects of second crosstalk 35 and indirect second crosstalk 35*a* are removed from the voice picked up by second microphone 23, in other words, is only separated voice 37 of the second conversation participant 12.

[2-3. Effects and Other Benefits]

Sound source separation device 20*a* according to this exemplary embodiment includes, in addition to functions for removing first crosstalk 32 and second crosstalk 35, which are included in sound source separation device 20 according to the first exemplary embodiment, functions for removing indirect first crosstalk 32*a* and indirect second crosstalk 35*a*. Therefore, similar to the first exemplary embodiment, relatively smaller hardware that does not use a conventional separation matrix can be used to further remove indirect first crosstalk 32*a* and indirect second crosstalk 35*a*. The function for removing indirect first crosstalk 32*a* is required when first microphone 21 and second loud speaker 24 are provided in an environment where acoustic coupling is so greater to an extent that indirect first crosstalk 32*a* cannot be neglected. In addition, the function for removing indirect second crosstalk 35*a* is required when second microphone 23 and first loud speaker 22 are provided in an environment where acoustic coupling is so greater to an extent that indirect second crosstalk 35*a* cannot be neglected.

In addition, the above described exemplary embodiment has been a sound source separation device. However, the above described exemplary embodiment may be achieved as a sound source separation method as described below. In other words, with the sound source separation method, a sound source separation device separates a voice of first conversation participant 11 and a voice of second conversation participant 12. The sound source separation device includes, first microphone 21 that picks up voice 36 of the first conversation participant 11, first loud speaker 22 that outputs voice 36 of the first conversation participant 11, second microphone 23 that picks up voice 37 of the second conversation participant 12, and second loud speaker 24 that outputs voice 37 of the second conversation participant 12. The sound source separation method includes a first crosstalk cancellation step and a second crosstalk cancellation step.

In the first crosstalk cancellation step, an output signal of the second crosstalk cancellation step is used to estimate and calculate a first interference signal indicative of degrees of first crosstalk 32 caused when a voice of second conversation participant 12 is picked up by first microphone 21 and indirect first crosstalk 32*a* caused when a voice of second conversation participant 12, which is output from second loud speaker 24, is picked up by first microphone 21, both of which are combined to each other. Then, the calculated first interference signal is removed from an output signal of first microphone 21, and a signal obtained after the removal is output to first loud speaker 22.

In the second crosstalk cancellation step, an output signal of the first crosstalk cancellation step is used to estimate and calculate a second interference signal indicative of degrees of second crosstalk 35 caused when a voice of first conversation participant 11 is picked up by second microphone 23 and indirect second crosstalk 35*a* caused when a voice of first conversation participant 11, which is output from first loud speaker 22, is picked up by second microphone 23, both of which are combined to each other. Then, the calculated second interference signal is removed from an output signal of second microphone 23, and a signal obtained after the removal is output to second loud speaker 24.

The sound source separation method as described above is performed by, for example, a processor for executing a program. In other words, first crosstalk canceller 50 and second crosstalk canceller 70 according to the above described exemplary embodiment may be achieved by a processor for executing a program.

In addition, the sound source separation method as described above may be achieved by a program recorded in a computer readable recording medium such as a CD-ROM.

Third Exemplary Embodiment

Next, a sound source separation device according to a third exemplary embodiment will now be described herein. The sound source separation device according to this exemplary embodiment is a device advantageous, compared with the sound source separation device according to the first exemplary embodiment, for separating voices of individual conversation participants when amplifying and assisting a conversation to which a third conversation participant 13 joins the first conversation participant 11 and the second conversation participant 12.

[3-1. Configuration]

Figure 4:
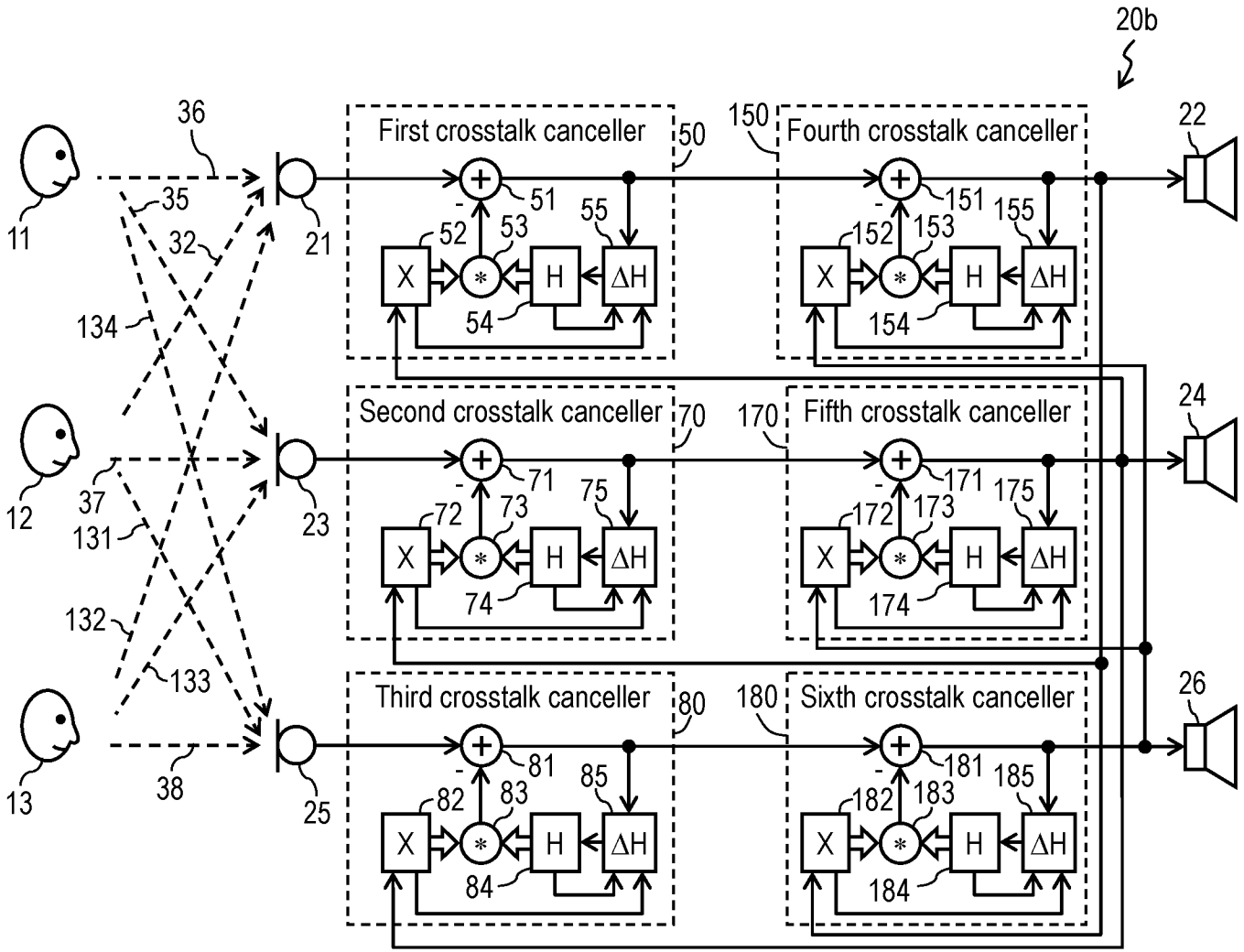
FIG. 4 is a block diagram illustrating a configuration of a sound source separation device according to a third exemplary embodiment.

FIG. 4 is a block diagram illustrating a configuration of sound source separation device 20*b* according to the third exemplary embodiment. Third microphone 25, third loud speaker 26, third crosstalk canceller 80, fourth crosstalk canceller 150, fifth crosstalk canceller 170, and sixth crosstalk canceller 180 are added to sound source separation device 20 according to the first exemplary embodiment to configure sound source separation device 20*b*. First microphone 21, second microphone 23, first loud speaker 22, second loud speaker 24, first crosstalk canceller 50, and second crosstalk canceller 70 are substantially identical to corresponding components of sound source separation device 20 according to the first exemplary embodiment. Hereinafter, components identical to components of the first exemplary embodiment are denoted by numerals or symbols identical to numerals or symbols used in the first exemplary embodiment, and descriptions of the components are omitted.

Third microphone 25 is a microphone that picks up a voice (third voice) of third conversation participant 13, and is provided, for example, at the ceiling above the rear seat (not illustrated). A voice signal output from third microphone 25 is, for example, digital voice data generated by the built-in A/D converter.

Third loud speaker 26 is a loud speaker that outputs voice 38 of the third conversation participant 13, and is provided, for example, at each of the inside faces of the two front doors of vehicle 10 (not illustrated). For example, after digital voice data is input and converted into an analog signal by the built-in D/A converter, third loud speaker 26 outputs the analog signal as a voice.

Third crosstalk canceller 80 uses an output signal of fifth crosstalk canceller 170 to estimate and calculate a third interference signal indicative of a degree of third crosstalk 131 caused when a voice of second conversation participant 12 is picked up by third microphone 25. In addition, the calculated third interference signal is removed from an output signal of third microphone 25, and a signal obtained after the removal is output to sixth crosstalk canceller 180. In this exemplary embodiment, third crosstalk canceller 80 is a digital signal processing circuit that processes digital voice data in a time axis domain.

More specifically, third crosstalk canceller 80 includes third transfer function storage circuit 84, third storage circuit 82, third convolution operation unit 83, third subtractor 81, and third transfer function update circuit 85.

Third transfer function storage circuit 84 stores a transfer function estimated as a transfer function with respect to third crosstalk 131.

Compared with first crosstalk canceller 50, third crosstalk canceller 80 is substantially identical in terms of a configuration and a basic operation of signal processing, and uses the transfer function stored in third transfer function storage circuit 84 to perform signal processing.

Fourth crosstalk canceller 150 uses an output signal of sixth crosstalk canceller 180 to estimate and calculate a fourth interference signal indicative of a degree of fourth crosstalk 132 caused when a voice of third conversation participant 13 is picked up by first microphone 21. In addition, the calculated fourth interference signal is removed from an output signal of first crosstalk canceller 50, and a signal obtained after the removal is output to first loud speaker 22. In this exemplary embodiment, fourth crosstalk canceller 150 is a digital signal processing circuit that processes digital voice data in a time axis domain.

More specifically, fourth crosstalk canceller 150 includes fourth transfer function storage circuit 154, fourth storage circuit 152, fourth convolution operation unit 153, fourth subtractor 151, and fourth transfer function update circuit 155.

Fourth transfer function storage circuit 154 stores a transfer function estimated as a transfer function with respect to fourth crosstalk 132.

Compared with first crosstalk canceller 50, fourth crosstalk canceller 150 is substantially identical in terms of a configuration and a basic operation of signal processing, and uses the transfer function stored in fourth transfer function storage circuit 154 to perform signal processing.

Fifth crosstalk canceller 170 uses an output signal of sixth crosstalk canceller 180 to estimate and calculate a fifth interference signal indicative of a degree of fifth crosstalk 133 caused when a voice of third conversation participant 13 is picked up by second microphone 23. In addition, the calculated fifth interference signal is removed from an output signal of second crosstalk canceller 70, and a signal obtained after the removal is output to second loud speaker 24. In this exemplary embodiment, fifth crosstalk canceller 170 is a digital signal processing circuit that processes digital voice data in a time axis domain.

More specifically, fifth crosstalk canceller 170 includes fifth transfer function storage circuit 174, fifth storage circuit 172, fifth convolution operation unit 173, fifth subtractor 171, and fifth transfer function update circuit 175.

Fifth transfer function storage circuit 174 stores a transfer function estimated as a transfer function with respect to fifth crosstalk 133.

Compared with first crosstalk canceller 50, fifth crosstalk canceller 170 is substantially identical in terms of a configuration and a basic operation of signal processing, and uses the transfer function stored in fifth transfer function storage circuit 174 to perform signal processing.

Sixth crosstalk canceller 180 uses an output signal of fourth crosstalk canceller 150 to estimate and calculate a sixth interference signal indicative of a degree of sixth crosstalk 134 caused when a voice of first conversation participant 11 picked up by third microphone 25. In addition, the calculated sixth interference signal is removed from an output signal of third crosstalk canceller 80, and a signal obtained after the removal is output to third loud speaker 26. In this exemplary embodiment, sixth crosstalk canceller 180 is a digital signal processing circuit that processes digital voice data in a time axis domain.

More specifically, sixth crosstalk canceller 180 includes sixth transfer function storage circuit 184, sixth storage circuit 182, sixth convolution operation unit 183, sixth subtractor 181, and sixth transfer function update circuit 185.

Sixth transfer function storage circuit 184 stores a transfer function estimated as a transfer function with respect to sixth crosstalk 134.

Compared with first crosstalk canceller 50, sixth crosstalk canceller 180 is substantially identical in terms of a configuration and a basic operation of signal processing, and uses the transfer function stored in sixth transfer function storage circuit 184 to perform signal processing.

[3-2. Operation]

In sound source separation device 20*b* according to this exemplary embodiment configured as described above, voice 36 of the first conversation participant 11, voice 37 of the second conversation participant 12, and voice 38 of the third conversation participant 13 are processed as described below.

Voice 36 of the first conversation participant 11 is picked up by first microphone 21. First crosstalk canceller 50 removes a first interference signal from an output signal of first microphone 21. A first interference signal is an (estimated) signal indicative of a degree of first crosstalk 32. Therefore, an output signal of first crosstalk canceller 50 is a signal representing a voice in which an effect of first crosstalk 32 is removed from the voice picked up by first microphone 21. This voice signal is input into fourth crosstalk canceller 150. That is, the output signal of first crosstalk canceller 50 is, as illustrated in FIG. 4, a voice signal of first microphone 21, in which first crosstalk 32 is removed, and is an input signal for fourth crosstalk canceller 150.

Fourth crosstalk canceller 150 removes a fourth interference signal from the output signal of first crosstalk canceller 50. A fourth interference signal is an (estimated) signal indicative of a degree of fourth crosstalk 132. Therefore, an output signal of fourth crosstalk canceller 150 is a signal representing a voice in which an effect of fourth crosstalk 132 is removed from the output signal of first crosstalk canceller 50. This signal is output from first loud speaker 22 as a voice. That is, the output signal of fourth crosstalk canceller 150 is, as illustrated in FIG. 4, a voice signal of first microphone 21, in which first crosstalk 32 and fourth crosstalk 132 are removed, and is an input signal for first loud speaker 22.

Therefore, the voice output from first loud speaker 22 is the voice in which the effects of first crosstalk 32 and fourth crosstalk 132 are removed from the voice picked up by first microphone 21, in other words, is only substantially separated voice 36 of the first conversation participant 11.

Similarly, voice 37 of the second conversation participant 12 is picked up by second microphone 23. Second crosstalk canceller 70 removes a second interference signal from an output signal of second microphone 23. A second interference signal is an (estimated) signal indicative of a degree of second crosstalk 35. Therefore, an output signal of second crosstalk canceller 70 is a signal representing a voice in which an effect of second crosstalk 35 is removed from the voice picked up by second microphone 23. This voice signal is input into fifth crosstalk canceller 170. That is, the output signal of second crosstalk canceller 70 is, as illustrated in FIG. 4, a voice signal of second microphone 23, in which second crosstalk 35 is removed, and is an input signal for fifth crosstalk canceller 170.

Fifth crosstalk canceller 170 removes a fifth interference signal from the output signal of second crosstalk canceller 70. A fifth interference signal is an (estimated) signal indicative of a degree of fifth crosstalk 133. Therefore, an output signal of fifth crosstalk canceller 170 is a signal representing a voice in which an effect of fifth crosstalk 133 is removed from the output signal of second crosstalk canceller 70. This signal is output from second loud speaker 24 as a voice. That is, the output signal of fifth crosstalk canceller 170 is, as illustrated in FIG. 4, a voice signal of second microphone 23, in which second crosstalk 35 and fifth crosstalk 133 are removed, and is an input signal for second loud speaker 24.

Therefore, the voice output from second loud speaker 24 is the voice in which the effects of second crosstalk 35 and fifth crosstalk 133 are removed from the voice picked up by second microphone 23, in other words, is only substantially separated voice 37 of the second conversation participant 12.

Similarly, voice 38 of third conversation participant 13 is picked up by third microphone 25. Third crosstalk canceller 80 removes a third interference signal from an output signal of third microphone 25. A third interference signal is an (estimated) signal indicative of a degree of third crosstalk 131. Therefore, an output signal of third crosstalk canceller 80 is a signal representing a voice in which an effect of third crosstalk 131 is removed from the voice picked up by third microphone 25. This voice signal is input into sixth crosstalk canceller 180. That is, the output signal of third crosstalk canceller 80 is, as illustrated in FIG. 4, a voice signal of third microphone 25, in which third crosstalk 131 is removed, and is an input signal for sixth crosstalk canceller 180.

Sixth crosstalk canceller 180 removes a sixth interference signal from the output signal of third crosstalk canceller 80. A sixth interference signal is an (estimated) signal indicative of a degree of sixth crosstalk 134. Therefore, an output signal of sixth crosstalk canceller 180 is a signal representing a voice in which an effect of sixth crosstalk 134 is removed from the output signal of third crosstalk canceller 80. This signal is output from third loud speaker 26 as a voice. That is, the output signal of sixth crosstalk canceller 180 is, as illustrated in FIG. 4, a voice signal of third microphone 25, in which third crosstalk 131 and sixth crosstalk 134 are removed, and is an input signal for third loud speaker 26.

Therefore, the voice output from third loud speaker 26 is the voice in which the effects of third crosstalk 131 and sixth crosstalk 134 are removed from the voice picked up by third microphone 25, in other words, only substantially separated voice 38 of the third conversation participant 13.

[3-3. Effects and Other Benefits]

Sound source separation device 20*b* according to this exemplary embodiment includes, in addition to the functions for removing first crosstalk 32 and second crosstalk 35, which are included in sound source separation device 20 according to the first exemplary embodiment, functions for removing third crosstalk 131, fourth crosstalk 132, fifth crosstalk 133, and sixth crosstalk 134, which are required when third conversation participant 13 joins a conversation between first conversation participant 11 and second conversation participant 12. Therefore, similarly to the first exemplary embodiment, relatively smaller hardware can be used to further remove third crosstalk 131, fourth crosstalk 132, fifth crosstalk 133, and sixth crosstalk 134, in addition to first crosstalk 32 and second crosstalk 35.

In addition, the above described exemplary embodiment is an exemplary application of a sound source separation device to a device for assisting in-cabin conversation. However, the sound source separation device is not limited to the device for assisting in-cabin conversation, but may be applied to a voice recognizer. More specifically, a voice can highly precisely be recognized by allowing the sound source separation device described above to separate voice signals of individual conversation participants, and to process the separated voice signals of the individual conversation participants with the voice recognizer. When a sound source separation device is applied to a voice recognizer, a loud speaker is not essential, differently from a case when the sound source separation device is applied to a device for assisting in-cabin conversation.

In addition, the above described exemplary embodiment has been a sound source separation device. However, the above described exemplary embodiment may be achieved as a sound source separation method as described below. In other words, with the sound source separation method, a sound source separation device separates a voice of first conversation participant 11, a voice of second conversation participant 12, and a voice of third conversation participant 13. The sound source separation device includes first microphone 21 that picks up voice 36 of a first conversation participant 11, second microphone 23 that picks up voice 37 of a second conversation participant 12, and third microphone 25 that picks up voice 38 of a third conversation participant 13. The sound source separation method includes a first crosstalk cancellation step, a second crosstalk cancellation step, a third crosstalk cancellation step, a fourth crosstalk cancellation step, a fifth crosstalk cancellation step, and a sixth crosstalk cancellation step.

In the first crosstalk cancellation step, an output signal of the fifth crosstalk cancellation step is used to estimate and calculate a first interference signal indicative of a degree of first crosstalk 32 caused when a voice of second conversation participant 12 is picked up by first microphone 21. In addition, the calculated first interference signal is removed from an output signal of first microphone 21, and a signal obtained after the removal is output.

In the second crosstalk cancellation step, an output signal of the fourth crosstalk cancellation step is used to estimate and calculate a second interference signal indicative of a degree of second crosstalk 35 caused when a voice of first conversation participant 11 is picked up by second microphone 23. In addition, the calculated second interference signal is removed from an output signal of second microphone 23, and a signal obtained after the removal is output.

In the third crosstalk cancellation step, an output signal of the fifth crosstalk cancellation step is used to estimate and calculate a third interference signal indicative of a degree of third crosstalk 131 caused when a voice of second conversation participant 12 is picked up by third microphone 25. In addition, the calculated third interference signal is removed from an output signal of third microphone 25, and a signal obtained after the removal is output.

In the fourth crosstalk cancellation step, an output signal of the sixth crosstalk cancellation step is used to estimate and calculate a fourth interference signal indicative of a degree of fourth crosstalk 132 caused when a voice of third conversation participant 13 is picked up by first microphone 21. In addition, the calculated fourth interference signal is removed from an output signal of the first crosstalk cancellation step, and a signal obtained after the removal is output.

In the fifth crosstalk cancellation step, an output signal of the sixth crosstalk cancellation step is used to estimate and calculate a fifth interference signal indicative of a degree of fifth crosstalk 133 caused when a voice of third conversation participant 13 is picked up by second microphone 23. In addition, the calculated fifth interference signal is removed from an output signal of the second crosstalk cancellation step, and a signal obtained after the removal is output.

In the sixth crosstalk cancellation step, an output signal of the fourth crosstalk cancellation step is used to estimate and calculate a sixth interference signal indicative of a degree of sixth crosstalk 134 caused when a voice of first conversation participant 11 picked up by third microphone 25. In addition, the calculated sixth interference signal is removed from an output signal of the third crosstalk cancellation step, and a signal obtained after the removal is output.

The sound source separation method as described above is performed by, for example, a processor for executing a program. In other words, first crosstalk canceller 50, second crosstalk canceller 70, third crosstalk canceller 80, fourth crosstalk canceller 150, fifth crosstalk canceller 170, and sixth crosstalk canceller 180 in the above described exemplary embodiment may be achieved by a processor for executing a program.

In addition, the sound source separation method as described above may be achieved by a program recorded in a computer readable recording medium such as a CD-ROM.

In this exemplary embodiment, an order of the first crosstalk cancellation step to be executed in first crosstalk canceller 50 and the fourth crosstalk cancellation step to be executed in fourth crosstalk canceller 150 may be changed. That is, an output signal of first microphone 21 is input into fourth crosstalk canceller 150, and a fourth interference signal is removed. An output signal of fourth crosstalk canceller 150 is treated as a voice signal of first microphone 21, in which the fourth interference signal is removed, and is input into first crosstalk canceller 50, and then a first interference signal is removed. An output signal of first crosstalk canceller 50 is treated as a voice signal of first microphone 21, in which the fourth interference signal and the first interference signal are removed, and is input into first loud speaker 22.

Similarly, an order of the second crosstalk cancellation step to be executed in second crosstalk canceller 70 and the fifth crosstalk cancellation step to be executed in fifth crosstalk canceller 170 may be changed. That is, an output signal of second microphone 23 is input into fifth crosstalk canceller 170, and a fifth interference signal is removed. An output signal of fifth crosstalk canceller 170 is treated as a voice signal of second microphone 23, in which the fifth interference signal is removed, and is input into second crosstalk canceller 70, and then a second interference signal is removed. An output signal of second crosstalk canceller 70 is treated as a voice signal of second microphone 23, in which the fifth interference signal and the second interference signal are removed, and is input into second loud speaker 24.

Similarly, an order of the third crosstalk cancellation step to be executed in third crosstalk canceller 80 and the sixth crosstalk cancellation step to be executed in sixth crosstalk canceller 180 may also be changed. That is, an output signal of third microphone 25 is input into sixth crosstalk canceller 180, and a sixth interference signal is removed. An output signal of sixth crosstalk canceller 180 is treated as a voice signal of third microphone 25, in which the sixth interference signal is removed, and is input into third crosstalk canceller 80, and then a third interference signal is removed. An output signal of third crosstalk canceller 80 is treated as a voice signal of third microphone 25, in which the sixth interference signal and the third interference signal are removed, and is input into third loud speaker 26.

Other Exemplary Embodiments

As described above, the first to third exemplary embodiments and the modification have been described as examples of the technique disclosed in this application. However, the technique of the present disclosure is not limited to the first to third exemplary embodiments and the modification, but can be applied to exemplary embodiments where modifications, replacements, additions, omissions, and the like are appropriately made. In addition, components described in the first to third exemplary embodiments and the modification can be combined to configure a new exemplary embodiment. Other exemplary embodiments will now be described herein.

For example, in the first to third exemplary embodiments, the convolution operation units respectively included in first crosstalk canceller 50 and second crosstalk canceller 70 each perform a convolution operation with N-tap FIR filter being an example of the convolution operation units. However, the convolution operation units may respectively be digital filters each having a different number of taps. In other words, a type of a digital filter may be appropriately and independently designed depending on factors including a transfer function with respect to an acoustic noise to be canceled.

In addition, in the first to third exemplary embodiments, update algorithms for transfer functions, which are executed by transfer function update circuits respectively included in first crosstalk canceller 50 and second crosstalk canceller 70 may each be a single algorithm, as represented by equations 3 and 6 described above. Alternatively, step size parameters may differ in a single algorithm, or different algorithms may be used. In other words, an update algorithm for a transfer function may be appropriately and independently designed depending on factors including a transfer function with respect to an acoustic noise to be canceled.

In addition, the above described exemplary embodiments have described examples of microphones and loud speakers included in a sound source separation device, such as a type where microphones and loud speakers are incorporated in a vehicle and a type where microphones and loud speakers are attached to a vehicle. However, microphones and loud speakers are not limited to these examples, but may be a microphone and/or a loud speaker included in a hand-held information terminal such as a smart phone. For example, a voice of a rear passenger in a vehicle is collected by a smart phone served as second microphone 23 (a rear microphone), is sent in a wireless manner to a head unit (a sound source separation device), and is amplified from a front loud speaker served as second loud speaker 24, in a state where crosstalk is suppressed. In addition, a voice of a driver collected by a front microphone served as first microphone 21 is sent in a wireless manner to the smart phone possessed by the rear passenger, and is amplified by a loud speaker of the smart phone served as first loud speaker 22 (a rear loud speaker), in a state where crosstalk is suppressed. Therefore, the rear passenger is able to make a conversation with the driver using the smart phone, and thus a rear microphone and a rear loud speaker are not required in the vehicle.

In addition, a sound source separation device, using a microphone and/or a loud speaker included in a hand-held information terminal such as a smart phone, as described above, is applicable as a Public Address (PA) system used in a lecture, for example. In the lecture, a voice of a questioner can be collected by his or her smart phone, can be sent in a wireless manner to the PA system, and can be amplified in a state where crosstalk is suppressed. Therefore, in the lecture, a time required to pass a microphone to the questioner can be shortened, questions and answers can smoothly be exchanged, and the lecture can be continued in a seamless manner.

As described above, the exemplary embodiments have been described for exemplifying the technique of the present disclosure. The appended drawings and the detailed description have been provided for that purpose.

Therefore, in order to exemplify the above described technique, the appended drawings and the detailed description include not only components that are essential for solving problems, but also components that are not essential for solving the problems. Accordingly, it should not be construed that the component that are not essential are essential because the components are described in the appended drawings and the detailed description.

In addition, since the above described exemplary embodiments are used for exemplifying the technique of the present disclosure, various modifications, replacements, additions, and omissions can be made within the scope of the claims and their equivalents.

INDUSTRIAL APPLICABILITY

The present disclosure is applicable to a sound source separation device that performs signal processing for reducing crosstalk on voice signals collected from a plurality of microphones. Specifically, the present disclosure is applicable to voice recognizers, hands-free telephones, conversation assisting devices, and other similar devices.

REFERENCE MARKS IN THE DRAWINGS

10: vehicle
11: first conversation participant
12: second conversation participant
13: third conversation participant
20, 20*a*, 20*b*: sound source separation device
21: first microphone
22: first loud speaker
23: second microphone
24: second loud speaker
25: third microphone
26: third loud speaker
32: first crosstalk
32*a*: indirect first crosstalk
35: second crosstalk
35*a*: indirect second crosstalk
36: voice of first conversation participant
37: voice of second conversation participant
38: voice of third conversation participant
50: first crosstalk canceller
51: first subtractor
52: first storage circuit
53: first convolution operation unit
54: first transfer function storage circuit
55: first transfer function update circuit
70: second crosstalk canceller
71: second subtractor
72: second storage circuit
73: second convolution operation unit
74: second transfer function storage circuit
75: second transfer function update circuit
80: third crosstalk canceller
81: third subtractor
82: third storage circuit
83: third convolution operation unit
84: third transfer function storage circuit
85: third transfer function update circuit
131: third crosstalk
132: fourth crosstalk
133: fifth crosstalk
134: sixth crosstalk
150: fourth crosstalk canceller
151: fourth subtractor
152: fourth storage circuit
153: fourth convolution operation unit
154: fourth transfer function storage circuit
155: fourth transfer function update circuit
170: fifth crosstalk canceller
171: fifth subtractor
172: fifth storage circuit
173: fifth convolution operation unit
174: fifth transfer function storage circuit
175: fifth transfer function update circuit
180: sixth crosstalk canceller
181: sixth subtractor
182: sixth storage circuit
183: sixth convolution operation unit
184: sixth transfer function storage circuit
185: sixth transfer function update circuit

The invention claimed is:

1. A sound source separation device comprising:

a first microphone that picks up a voice signal including a first voice;

a second microphone that picks up a voice signal including a second voice;

a first crosstalk canceller that removes, from the voice signal of the first microphone, first crosstalk caused when the second voice is picked up by the first microphone and indirect first crosstalk caused when the second voice output from the second loud speaker is picked up by the first microphone;

a second crosstalk canceller that removes, from the voice signal of the second microphone, second crosstalk caused when the first voice is picked up by the second microphone and indirect second crosstalk caused when the first voice output from the first loud speaker is picked up by the second microphone, and;

a first loud speaker that outputs the first voice output from the first crosstalk canceller; and a second loud speaker that outputs the second voice output from the second crosstalk canceller, wherein the first crosstalk canceller uses a voice signal in which the second crosstalk and the indirect second crosstalk are removed from the voice signal of the second microphone to estimate and calculate a first interference signal indicative of degrees of the first crosstalk and the indirect first crosstalk, and to remove the calculated first interference signal from the voice signal of the first microphone, the second crosstalk canceller uses a voice signal in which the first crosstalk and the indirect first crosstalk are removed from the voice signal of the first microphone to estimate and calculate a second interference signal indicative of degrees of the second crosstalk and the indirect second crosstalk, and to remove the calculated second interference signal from the voice signal of the second microphone, for the second voice uttered at a certain time, a time when the voice signal of the second microphone is input into the first crosstalk canceller is identical to or earlier than a time when the second voice is picked up by the first microphone, and for the first voice uttered at a certain time, a time when the voice signal of the first microphone is input into the second crosstalk canceller is identical to or earlier than a time when the first voice is picked up by the second microphone.

2. The sound source separation device according to claim 1, wherein the first crosstalk canceller includes:

a first transfer function storage circuit that stores the transfer function estimated as a transfer function with respect to the first crosstalk and the indirect first crosstalk;

a first storage circuit that stores the output signal of the second crosstalk canceller;

a first convolution operation unit that performs a convolution on the output signal stored in the first storage circuit and the transfer function stored in the first transfer function storage circuit to generate the first interference signal;

a first subtractor that removes, from the output signal of the first microphone, the first interference signal output from the first convolution operation unit to output an obtained signal as the output signal of the first crosstalk canceller; and a first transfer function update circuit that updates the transfer function stored in the first transfer function storage circuit based on the output signal of the first subtractor and the output signal stored in the first storage circuit, and the second crosstalk canceller includes:

a second transfer function storage circuit that stores the transfer function estimated as a transfer function with respect to the second crosstalk and the indirect second crosstalk;

a second storage circuit that stores the output signal of the first crosstalk canceller;

a second convolution operation unit that performs a convolution on the output signal stored in the second storage circuit and the transfer function stored in the second transfer function storage circuit to generate the second interference signal;

a second subtractor that removes, from the output signal of the second microphone, the second interference signal output from the second convolution operation unit to output an obtained signal as the output signal of the second crosstalk canceller;

a second transfer function update circuit that updates the transfer function stored in the second transfer function storage circuit based on the output signal of the second subtractor and the output signal stored in the second storage circuit;

the first transfer function update circuit uses an independent component analysis to update the transfer function stored in the first transfer function storage circuit based on the output signal of the first subtractor and the output signal stored in the first storage circuit so that the output signal of the first subtractor and the output signal stored in the first storage circuit are independent from each other, and the second transfer function update circuit uses an independent component analysis to update the transfer function stored in the second transfer function storage circuit based on the output signal of the second subtractor and the output signal stored in the second storage circuit so that the output signal of the second subtractor and the output signal stored in the second storage circuit are independent from each other.

3. The sound source separation device according to claim 2, wherein the first transfer function update circuit performs nonlinear processing using a nonlinear function on the output signal of the first subtractor, multiplies an obtained result by the output signal stored in the first storage circuit and a first step size parameter for controlling a learning speed in estimating the transfer function with respect to the first crosstalk and the indirect first crosstalk to calculate a first update coefficient, and adds the calculated first update coefficient to the transfer function stored in the first transfer function storage circuit for updating, and the second transfer function update circuit performs nonlinear processing using a nonlinear function on the output signal of the second subtractor, multiplies an obtained result by the output signal stored in the second storage circuit and a second step size parameter for controlling a learning speed in estimating the transfer function with respect to the second crosstalk and the indirect second crosstalk to calculate a second update coefficient, and adds the calculated second update coefficient to the transfer function stored in the second transfer function storage circuit for updating.

4. The sound source separation device according to claim 3, wherein the nonlinear function used in each of the first transfer function update circuit and the second transfer function update circuit is a sigmoid function, a hyperbolic tangent function, a normalized linear function, or a sign function.

5. The sound source separation device according to claim 1, further comprising:

a third microphone that picks up a third voice;

a third crosstalk canceller that removes, from a voice signal of the third microphone, third crosstalk caused when the second voice is picked up by the third microphone;

a fourth crosstalk canceller that removes, from a voice signal of the first microphone, fourth crosstalk caused when the third voice is picked up by the first microphone;

a fifth crosstalk canceller that removes, from a voice signal of the second microphone, fifth crosstalk caused when the third voice is picked up by the second microphone; and a sixth crosstalk canceller that removes, from a voice signal of the third microphone, sixth crosstalk caused when the first voice is picked up by the third microphone, wherein the first crosstalk canceller uses a voice signal in which the second crosstalk and the fifth crosstalk are removed from the voice signal of the second microphone to estimate the first interference signal, the second crosstalk canceller uses a voice signal in which the first crosstalk and the fourth crosstalk are removed from the voice signal of the first microphone to estimate the second interference signal, the third crosstalk canceller uses a voice signal in which the second crosstalk and the fifth crosstalk are removed from the voice signal of the second microphone to estimate and calculate a third interference signal indicative of a degree of the third crosstalk, and to remove the calculated third interference signal from the voice signal of the third microphone, the fourth crosstalk canceller uses a voice signal in which the third crosstalk and the sixth crosstalk are removed from the voice signal of the third microphone to estimate and calculate a fourth interference signal indicative of a degree of the fourth crosstalk, and to remove the calculated fourth interference signal from the voice signal of the first microphone, the fifth crosstalk canceller uses a voice signal in which the third crosstalk and the sixth crosstalk are removed from the voice signal of the third microphone to estimate and calculate a fifth interference signal indicative of a degree of the fifth crosstalk, and to remove the calculated fifth interference signal from the voice signal of the second microphone, and the sixth crosstalk canceller uses a voice signal in which the first crosstalk and the fourth crosstalk are removed from the voice signal of the first microphone to estimate and calculate a sixth interference signal indicative of a degree of the sixth crosstalk, and to remove the calculated sixth interference signal from the voice signal of the third microphone.

6. A sound source separation method performed in a sound source separation device that separates a first voice and a second voice from a voice signal including the first voice and the second voice, the sound source separation device including a first microphone that picks up the first voice, a second microphone that picks up the second voice, a first loud speaker that outputs the first voice; and a second loud speaker that outputs the second voice, the sound source separation method comprising:

a first crosstalk cancellation process of removing, from a voice signal of the first microphone, first crosstalk caused when the second voice is picked up by the first microphone and indirect first crosstalk caused when the second voice output from the second loud speaker is picked up by the first microphone; and a second crosstalk cancellation process of removing, from a voice signal of the second microphone, second crosstalk caused when the first voice is picked up by the second microphone and indirect second crosstalk caused when the first voice output from the first loud speaker is picked up by the second microphone, wherein, in the first crosstalk cancellation process, a voice signal in which the second crosstalk and the indirect second crosstalk are removed from the voice signal of the second microphone in the second crosstalk cancellation process is used to estimate and calculate a first interference signal indicative of degrees of the first crosstalk and the indirect first crosstalk, and to remove the calculated first interference signal from the voice signal of the first microphone, and in the second crosstalk cancellation process, a voice signal in which the first crosstalk and the indirect first crosstalk are removed from the voice signal of the first microphone in the first crosstalk cancellation process is used to estimate and calculate a second interference signal indicative of degrees of the second crosstalk and the indirect second crosstalk, and to remove the calculated second interference signal from the voice signal of the second microphone, for the second voice uttered at a certain time, a time when the voice signal of the second microphone is input is identical to or earlier than a time when the second voice is picked up by the first microphone, and for the first voice uttered at a certain time, a time when the voice signal of the first microphone is input is identical to or earlier than a time when the first voice is picked up by the second microphone.

* * * * *